US008668542B2

(12) United States Patent
Bruzgul

(10) Patent No.: US 8,668,542 B2
(45) Date of Patent: Mar. 11, 2014

(54) ALL-SEASON INDOOR OUTDOOR COUPLEABLE CONSTRUCTION TOYS

(76) Inventor: Joshua D Bruzgul, East Aurora, NY (US)

( * ) Notice: Subject to any disclaimer, the term of this patent is extended or adjusted under 35 U.S.C. 154(b) by 386 days.

(21) Appl. No.: 12/779,235

(22) Filed: May 13, 2010

(65) Prior Publication Data

US 2010/0221977 A1 Sep. 2, 2010

Related U.S. Application Data

(63) Continuation-in-part of application No. 11/413,317, filed on Apr. 28, 2006, now abandoned.

(51) Int. Cl.
*A63H 33/00* (2006.01)

(52) U.S. Cl.
USPC ..... 446/85; 297/248; 297/440.14; 211/188; 211/126.12; 211/194; 280/15; 280/603; 114/264; 114/267; 446/487

(58) Field of Classification Search
USPC ..... 446/487, 85–128, 227; 211/188, 194, 211/126.12; 280/15, 603; 297/248, 440.12; 114/264, 267
See application file for complete search history.

(56) References Cited

U.S. PATENT DOCUMENTS

| | | | | | |
|---|---|---|---|---|---|
| 600,812 | A * | 3/1898 | Swanson | 297/234 |
| 3,422,564 | A * | 1/1969 | Izumi | 446/74 |
| 3,628,206 | A * | 12/1971 | Mecham | 280/18.1 |
| 3,669,494 | A * | 6/1972 | Lohmeyer | 297/440.14 |
| 3,713,247 | A * | 1/1973 | Parrilla | 446/71 |
| 4,275,666 | A * | 6/1981 | Schriever | 108/101 |
| 4,459,714 | A * | 7/1984 | Lin | 5/655.3 |
| 4,500,719 | A * | 2/1985 | Oba et al. | 548/522 |
| 4,505,265 | A * | 3/1985 | Cronenwett et al. | 128/845 |
| 4,561,208 | A * | 12/1985 | Schultz | 47/83 |
| 4,608,770 | A * | 9/1986 | Gray | 40/730 |
| 4,685,892 | A * | 8/1987 | Gould et al. | 446/109 |
| 4,758,196 | A * | 7/1988 | Wang | 446/104 |
| 4,968,040 | A * | 11/1990 | McElhaney | 273/294 |
| 5,197,404 | A * | 3/1993 | Haley et al. | 114/267 |
| 5,330,379 | A * | 7/1994 | Roh et al. | 297/440.14 |
| 5,509,720 | A * | 4/1996 | Croom | 297/440.14 |
| 5,715,948 | A * | 2/1998 | Hung | 211/40 |
| 6,112,910 | A * | 9/2000 | Baxter | 211/40 |
| 6,318,571 | B1 * | 11/2001 | Maumus et al. | 211/194 |
| 6,733,082 | B1 * | 5/2004 | Treon | 297/248 |
| 6,796,443 | B2 * | 9/2004 | Lippman et al. | 211/131.1 |
| 6,899,588 | B1 * | 5/2005 | Clever et al. | 446/120 |
| 6,941,887 | B2 * | 9/2005 | Monlezun | 114/345 |
| 7,100,927 | B2 * | 9/2006 | Krent | 280/16 |
| 7,104,864 | B1 * | 9/2006 | Liou | 446/221 |
| 2005/0287906 | A1 * | 12/2005 | He | 446/109 |

* cited by examiner

*Primary Examiner* — Gene Kim
*Assistant Examiner* — Urszula M Cegielnik
(74) *Attorney, Agent, or Firm* — Patricia M. Costanzo, Esq.

(57) ABSTRACT

A multiple use, light weight, cost-effective, indoor and all-weather outdoor construction toy for stimulating children's imaginations and encouraging physical activity comprises a basic modular unit with open ended cup-like coupling-means on its perimeter for male to female coupling and decoupling to other couple-able units, is described. The coupling-means may be molded as an integral part forming one seamless basic unit. The open bottom end of the coupling means provides for coupling, the open top end prevents the buildup of snow inside the coupling unit. Coupling can be achieved via coupling-means on basic units to each other or through the use of accessory independent coupler-units. The basic unit of the modular toy may be in the form of a saucer, disc, an oval, or in a rectilinear-shape for use as a sled, skiing device, a flotation device, or as fort building modules. Additional accessory parts include skis and inner-tubes, for example.

17 Claims, 22 Drawing Sheets

ALL-SEASON INDOOR OUTDOOR COUPLEABLE CONSTRUCTION TOYS

CROSS-REFERENCE TO RELATED APPLICATIONS

This Continuation-in-Part claims the benefit of Non-provisional application Ser. No. 11/413,317 filed on Apr. 28, 2006

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to building toys and, more particularly, to indoor and all-season outdoor coupleable/decoupleable modular construction toys.

The background information discussed below is presented to better illustrate the novelty and usefulness of the present invention. This background information is not admitted prior art.

The market for toys and games is a booming industry in the United States and around the world. Nearly $40 billion dollars each year is spent on the newest and most popular games and toys, and since deregulation of children's television in 1984, there has been an explosion of multi-media based toys. At least half of all new toys this year are projected to be such toys and it is predicted that this ratio will grow.

In addition to multi-media based toys; there is an abundance of electronic games and gadgets aimed at getting a child's attention. These toys are known to have deleterious effects on children. Many of these toys encourage imitative play that can promote undesirable behavior in children, especially when the toys are based on television shows and movies that promote violence as they often lead children into imitating the violence in their play.

SUMMARY

The present inventor realized that most the new toys and/or games coming on the market, regardless of how costly, do not hold a child's interest for long. The Inventor concluded this is due, in part, to the fact that more and more toys are designed for "imitative" play where a child is encouraged to imitate characters made popular by the television shows, movies, and books. Imitative toys present an ordered activity of play that undermine a child's imagination, creativity, and ability to recognize and appreciate interesting problems to explore and solve. Examples of such ordered activity toys include computer based toys and games that usually result in children sitting passively indoors for hours, instead of being involved in active outdoor play. Moreover, many of these presently available toys are provided with a comprehensive set of game playing rules that leave little room for independent thinking undermining active play and discouraging creativity. The present inventor theorized that a child's interest in playing with a toy would be extended if the child's imagination had to be utilized in order to play with the toy.

As a parent, who also happens to be trained in the medical field, the present Inventor appreciates the beneficial and therapeutic effects that imaginative play, especially outdoors imaginative play, activity promotes. Physical activity helps children sleep better at night and helps battle the obesity epidemic among America's youngsters. Moreover, physical activity may help reduce hyperactivity in children. When a child in involved in an activity that requires both mental and physical activity his and her level of independence, resourcefulness, and competence grow, which of course helps the children to develop into positively oriented, creative, and competent adults.

The present inventor studied the many attempts to provide toys that encourage active, creative, outdoors play. One set of such toys include inflatable toys and injection molded boats or polyurethane foam floating toys of various shapes for use in water areas, such as in swimming pools or at the beach. Injection molded plastic floating toys while providing some incentive for summer time activity, are not only costly, which seems even costlier in northern climates where their period of use is limited, but their creative stimulation value is minimal at best. A similar situation exits with expensive inflatable winter sledding toys, which can be used only for the snowy months of the year. Moreover, both of these seasonal toys require storage during their "off" seasons and as children physically and developmentally outgrow such toys within a few years, their lifespan is limited.

One attempt at providing for a multiple use outdoors toy offers a convertible, floatable toy that can be used either in the water or for downhill sledding and comes is equipped with steering capability and contains interchangeable parts, which include a water propulsion means or ski runners. While this toy has the versatility of use in the water as a floatation device or in the snow as a sled, it serves no purpose as a toy in any other environment. So, while its dual nature may save parents some expense, and while it may encourage children to play outdoors, this device must be used either in water or on snow and only minimally does it encourage a child's creativity. Additionally, its interchangeable parts offer only two toys for the price of one.

Another attempt at providing for an outdoors toy with multiple uses is a multi-season ski sled for use in skiing and sledding. The ski sled is not used for conventional skiing because the user's feet are not fixed to the ski runners. Instead, the "ski sled" refers to the use of a ski runner for sliding over the snow or the use of ski runners in fixed parallel or tandem relationship. This invention provides a multi-season ski sled that can be used for skiing or sledding because it also has detachably mounted wheel assemblies that convert the ski sled for scooting use. Although this invention may be used on snow or dry land, it cannot be used in the water, and does not require much creativity.

Another attempt to fulfill the as yet unmet need is a sled that has a plurality of wheels for use when desired. The sled also has a steering member operatively coupled to at least two of the several pairs of wheels and a hand brake that is attached to the steering member. While this invention is a toy that can serve both as a sled for use on snow or as a sled with wheels for use on dry land or on snow, it cannot be used in the water.

Accordingly, the present inventor teaches herein a child's toy that encourages children to use their imagination while being fun, safe, and durable. The toy is designed to accommodate a growing child's changing interests and encourages both mental and physical indoor and outdoor activity in all seasons. Moreover the toy provides creative challenging play for children of a range of ages, from young to beyond the teen years.

The primary toy devised by the present Inventor consists of a basic modular unit having a body section, a perimeter that is, or approximates being equidistant from the center of the unit, and couplers extending out away from the perimeter, A perimeter is herein described as the continuous path that surrounds an area. The term may be thought of as the length of the outline of a shape. The perimeter of a circular area is called circumference. Hence, as used herein a basic unit having a round shape has a circumference that is equidistant from the center of the unit at all points of the circumference. Basic modular units are also contemplated being shaped as regular polygons, for example as having a perimeter that can be defined as a hexagon, octagon, or a similar shape. A regular polygon is defined as an equilateral polygon which is cyclic, that is its vertices are on a circle and thus all of the vertices are equidistant from the center of the unit. This provides for all basic units having or generally having a perimeter that approximates being equi-dimensional from the center of the unit.

The center of each basic unit is depressed to provide a comfortable seating area for the user regardless if the unit is being used with a flotation device or as sled. The depressed seating area helps to secure the user in the sled preventing the sled user from falling off of the sled.

The facts that each basic unit is round, or a regular polygon, and that each basic unit has a centrally located depressed seating area results in a weight stable configuration. That is, the weight of the user is kept in the center of the sled, thus stabilizing the user on the sled and also stabilizing the combination of user and sled.

Each basic unit may be used as is, that is by itself, but also may be used in conjunction with other basic modular units. Each basic unit has one or more couplers extending out from the equi-dimensional, or nearly equi-dimensional, perimeter of each sled. The couplers are used to attach basic units to other basic units. In the example illustrated, the couplers are male/female couplers designed to be an extension off of the perimeter of the basic unit, in that they are formed as part of the basic unit at the time the basic unit is formed but extend out away from the perimeter of the basic unit. One method of manufacture would be by a molding process. The cup-like shape of the couplers provides for each coupler to be used as both a male and a female coupling unit.

Coupling basic units to each other provides children with an array of construction options, such as the ability to build a multi-user sled, a walled fort, and a domed fort similar to an igloo. Two basic units may be coupled to form a side by side couplet sled. Three sleds may be coupled so that they are arranged in a line and can be used as a train or a line of units extending from the right and/or left of another user. Alternatively, three sleds may be coupled so that a line connecting the center points of each of the sleds describes a triangle. The number of sleds that can be coupled is limited only by the number of users and the space available. The sleds may be used in such configurations because each sled and rider is weight stable due to a user being positioned in the center depression of the unit, as discussed above.

One series of basic units are sized so that each basic unit fits snuggly, safely, and securely into the open center of any standard sized inflatable, floatable inner-tubes. The fact that the male/female couplers extend out away from the perimeter of the basic unit provide for basic units, even while positioned within an inner-tube to be coupled. In fact a basic unit in an inner-tube can be coupled to another basic unit that is not positioned in an inner-tube.

The basic units may be coupled to directly each other, as taught above, or through the use of a separate coupler unit. A coupler unit has a triangularly shaped body with female/male couplers on the apex of each of the three vertices. The female/male couplers of the coupler units are shaped and sized to be used with any of the couplers on any of the other basic units.

The fact that each unit has a set of couplers means that the each unit is attachable to various accessories. For example, the invention includes providing for skis that can be used with a basic unit for skiing on either snow or water. Each ski is equipped with one or more couplers that are couple-able to the couplers of a basic unit.

When the discs are coupled side by side in a vertical orientation to form a circle, a vertically-walled fort is formed. Basic units may be added to the upper portions of the basic units forming the walls to form a domed fort.

Another accessory is a turn-table onto which a basic unit may be attached providing for a spinning toy. Attachable to an accepting aperture of the turntable is a propeller sitting atop a long shaft so that while the bottom of the propeller shaft is fitted into and supported by the accepting aperture of the turntable the propeller extends out above a fort made of basic units.

Also available are a collection of accessories that extend the number of ways the basic unit can be used and that provide an endless array of toys that engage the imagination as well as require physical activity from children, such as sliding toys, tricycle toys, and toys with roofs. Such accessory pieces provide children the options of constructing a more complicated domed fort with helicopter or airplane like appendages, a water or snow ski-able device, tricycles, and floatable devices, including water tricycles. The toys are constructed of buoyant, water and weather resistant materials that provide for the toys to be used indoors or out, winter or summer. As taught herein, the toys encourage active play to help children build and maintain physical strength and endurance. According to the principles of the present invention, the toy also encourages contemplation, imagination, and confidence. Its use is open ended, there is no one way a child should be playing with the toy, its use induces imaginative and creative play. Moreover, the toy inspires children to more deeply explore their imaginations to develop their own creative ideas. Furthermore, use of the toy often presents children with various technical problems allowing and encouraging children to explore various ways to resolve the problems. Once the problem is solved, the child is able to experience pride and satisfaction in their successful problem solving. The various ways in which the toy may be used are limited only by the child's imagination and thus, is likely to maintain a child's interest. The toy may be used equally well by one child or by a number of children. Importantly, the toy is inexpensive to make, partly because it can be produced by common molding techniques using available and low cost materials, so that it is affordable for all.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in appended drawings wherein like reference characters indicate like parts throughout the several figures. It should be understood that these drawings only depict preferred embodiments of the present invention and are not therefore to be considered limiting in scope, thus, the invention will be described and explained with additional specificity and detail through the use of the accompanying drawings, in which.

A LIST OF REFERENCE NUMERALS AND THE PARTS TO WHICH THEY REFER

Figure 1A:
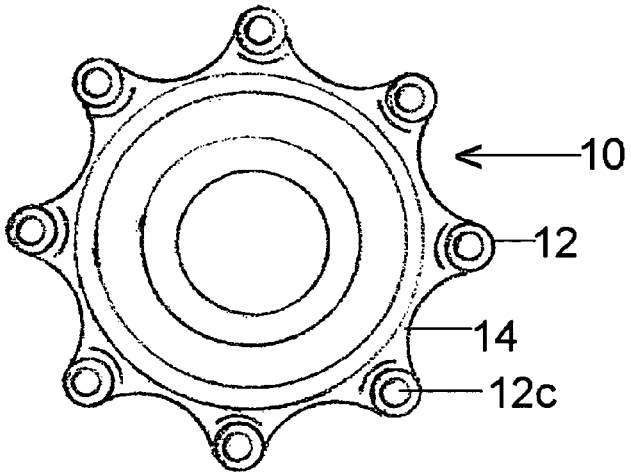
FIG. 1*a* is a top plan view illustrating a basic unit of the toy of the present invention.

10 Basic unit of multi-seasonal, multi-use modular construction toy with coupling-means 12.
12 Cup-shaped coupling-means.
12*a* Alternative coupling-means.
12*c* Aperture within coupling-means 12.
12*d* Aperture within coupling-means 12.
12*e* Aperture within coupling-means 12.
12*k* Aperture within coupling-means 12.
14 Body part of basic unit 10.
16 Upper or sitting surface of 14.
18 Bottom surface of 14.
20 Coupler-unit with three coupler-means 12.
24 Body part of coupler-unit 20.
30 A second styled coupler-unit with alternative coupler-means 12*a*.
34 Body frame part of coupler-unit 30.
36 Threaded apertures.
50 Tube-disc, a basic unit in combination with inner tube.
55 Inner tube.
55*a* A first inner tube.
55*b* A second inner tube.
60 Basic unit 10 with skis 64 and 64*s* attached via coupling-means 12.
62 Front side of full length ski with two coupling-means.
62*s* Front side of short ski with a coupling-means.
63 Back side of full length ski with two coupling-means.
63*s* Back side of short ski with a coupling-means.
64 Full length ski with coupling-means.
64*s* Short ski with a coupling-means.
70 A vertically walled structure comprising six coupled basic units.
80 A domed structure comprising nine coupled basic units.
90 A domed structure comprising thirteen coupled basic units.
100 A turn table sitting device.
103 An aperture.
105 Rotable seating platform of 100.
107 Rotable shaped shaft connecting 105 and 109*a*.
109 Base part of 100.
109*a* Top part of base part of 100.
109*b* Bottom part of base part of 100.
110 Helicopter-like toy.
111 Multi-use device comprising part 122 that may function as part of an oar, paddle, propeller, or support, for example, and shaft part 119.
115 Rotable connecting part for connecting 120 to 117.
119 Long, rod-like shaft.
119*a* A first long, rod-like shaft.
119*b* A second long, rod-like shaft.
120 Airplane-like toy made using 90.

122 Propeller-like curved blades.
130 Steerable multiple coupled tube-discs sled.
132 Threaded connector means.
132*a* Rod shaped connector means.
132*b* Coupling connector aperture.
133 Coupleable steering bar.
135 Coupleable sled.
136 Coupleable accessory seat.
136*a* Upwardly directed portion of accessory seat 136.
136*b* Coupleable aperture for accepting 136*c*.
136*c* Coupleable stem for inserting into 136*b*.
137 Coupleable backrest.
139 Coupleable sled attachment means.
139*a* Washer for coupleable sled attachment means 139.
139*b* Threaded bolt for coupleable sled attachment means 139.
139*c* Nut for coupleable sled attachment means 139.
140 A coupleable tricycle.
142 Rear wheel.
142*a* Outside side of rear tire.
142*b* Inside side of rear tire.
142*c* Threaded axel receiving aperture of rear tire.
143 Front wheel.
144 Pedals.
145 Rear tire axel.
146 Steering fork.
148 Crank arm.
150 Water disc-cycle.
160 Another style coupler-unit of this invention.
165 Body part of coupler-unit 160.
166 Casting impressions for making snow or ice cube-like toys.
170 Central open space in 174 for holding axel and to serve as inlet of water.
174 Right side and left side planar wheel cover faces.

It should be understood that the drawings are not necessarily to scale. In certain instances, details which are not necessary for an understanding of the present invention or which render other details difficult to perceive may have been omitted.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described herein.

The present invention is a toy that provides a range of play choices. The fundamental structure on which all variations are based is what we refer to as the basic unit. In one favored embodiment, illustrated herein, a basic unit comprises a disc-shaped saucer that is available in a smaller size to support one child or in a larger size to support several. It is to be understood that the shape and the size of the basic unit may vary, as desired, and that the invention does not reside in either the shape or the size of the units of the present invention. However, the there are some features upon which the invention relies. In order to provide for the maximum amount of stability each basic unit should be either round or have a shape of a regular polygon. All of the vertices of a regular polygon lie on a common circle (the circumscribed circle) which is what is referred to as the perimeter of the basic units as described herein. These shapes all share the fact that either all points on the circumference (the perimeter) of the basic unit or all of the vertices of the perimeter of the basic unit are equidistant from the center point of the basic unit, which is turn provides the seating position of greatest stability for the user on the unit. Additionally, each unit is made to have a depressed center to provide for a comfortable and secure seating area. By itself, the disc-like device may be used as a sled for gliding on surfaces one equates with winter-like weather. The toy, however, is designed to be much more than a simple saucer or sled. For example, it may also be used in conjunction with a floatation device, such as an inner-tube for use either in winter on the snow or in summer on the water, which will be described in more detail below. As such, the fundamental basic unit of the toy may be fully enjoyed by itself.

Each fundamental basic toy unit however is provided with coupling means that extend out away from the perimeter of the basic unit so that, when desired, each basic unit may be coupled to other basic units to provide the user with a wide variety of toys. Additionally, the invention includes accessory pieces that further expand the ways the toy may be used. One such accessory is a set of skis where each ski is provided with one or more coupling means that are couple-able with the coupling means on a basic unit. The resulting ski-sled could be used either in winter on the snow or in summer on the water. Furthermore, each of the basic units may be coupled to one or two other basic units to provide for a multi-ski-vehicle toy. Moreover, the basic units may be coupled, either directly, or indirectly using one of a variety of coupling units, to other basic units to provide for a walled or domed forts.

Figure 1B:
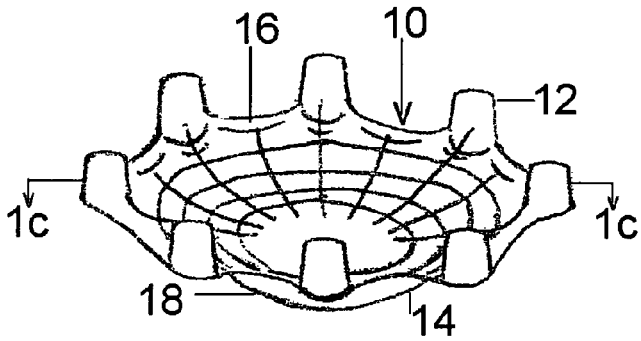
FIG. 1*b* is a perspective view illustrating a basic unit, as shown in FIG. 1*a*.
Figure 1C:
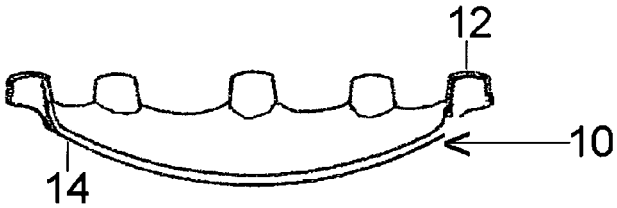
FIG. 1*c* is a cross-sectional view taken along line 1*c*-1*c* of FIG. 1*b*.

Turning now to the drawings, FIG. 1*a*, a top plan view, illustrates basic unit 10 of the modular construction toy of this invention. In this exemplary illustration, basic unit 10 is presented as a saucer-like disc form having a circumferential perimeter. As mentioned, it is to be appreciated that a modular construction toy basic unit according to the principles of the present invention may assume a variety of shapes, as long as the shapes may be described as polygonal to provide maximum stability for a user on the basic unit, has a depressed central seating area, and is available in a variety of sizes. FIG. 1*a*, a planar view, and FIG. 1*b*, a perspective view, illustrate coupling means 12 disposed about and extending out and away from the perimeter of body 14 of basic unit 10. Coupling means 12 in the example illustrated are male to female couplers providing for coupling and decoupling of the basic unit to like coupling-means of at least one other unit, such as another basic unit or other types of units which will be discussed below. Body 14 comprises an upper sitting surface 16 and bottom surface 18. The embodiment chosen for illustration presents body 14 in the form of a circular disc, which is but one of many possible styles for the basic unit. The convex disc shape of upper sitting surface 16 provides for a depressed comfortable and secure seat for one or more users. In the example illustrated, the basic unit has a round shape, meaning that all points on the perimeter (the circumference) of the body are equidistance from the center. The centering of a user in a centrally located depressed seating area provides for the user to be in a maximum stable position. FIG. 1*c*, a cross-sectional view, of the basic unit, illustrates clearly that in this embodiment coupling means 12 are molded as an integral part of the basic unit. FIG. 1*a* and FIG. 1*b* illustrate eight coupling means positioned proximate to, but extending, out away from the perimeter of the saucer shaped disc. Having the coupling means extending out and away from the perimeter of the body of the unit provides for the modular construction toy basic unit 10 to be linked directly to other like modular construction toy basic units (see FIG. 4*a*).

It is to be understood that the number of coupling means is not confined to eight coupling means; any number desired will be effective. In the examples illustrated, the coupling means are presented as female/male coupling cups 12. In this embodiment, coupling cups 12 are shown as cups with both their top and bottom ends open. The bottom ends of the coupling means 12 are open to receive other coupling means for coupling purposes. The top ends of coupling means 12 are open to avoid the coupling cups from becoming packed with snow when the toy is used in the snow.

Figure 2A:
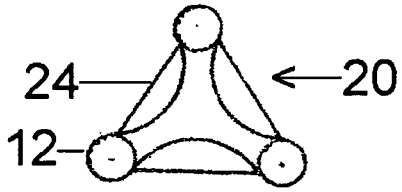
FIG. 2*a* is a top plan view illustrating a coupler-unit of this invention.
Figure 2B:
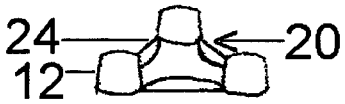
FIG. 2*b* is a partial perspective view of the coupler-unit illustrated in FIG. 2*a*.
Figure 2C:
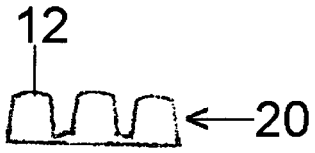
FIG. 2*c* is a side plan view of the coupler-unit, as illustrated in FIGS. 2*a* and 2*b*.

FIG. 2*a*, a top plan view, and FIG. 2*b*, a partial perspective view, illustrate one embodiment of a coupler-unit according to the principles of this invention. Central coupler body 24 of coupler-unit 20 is illustrated having a triangular polygonal perimeter with coupling-means 12 affixed proximate to but extending our and away from said perimeter, wherein coupling-means 12 provide for male or female coupling and decoupling of said coupler-unit to like coupling-means on at least one other unit provided with coupling means. FIG. 2*c* a side plan view of the coupler coupling means, illustrates coupling-means 12 molded as an integral part of coupler-unit 20 forming one seamless coupler-unit. As are the coupling means discussed above, the bottom ends of the coupling means 12 of coupler-unit 20 are open to receive other coupling means for coupling purposes. The top ends of coupling means 12 are open to avoid the coupling cups from becoming packed with snow when the toy is used in the snow.

Figure 3A:
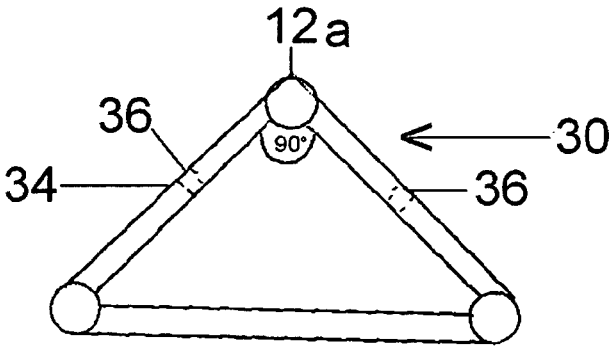
FIG. 3*a* is a top plan view illustrating another style coupler-unit of this invention.

FIG. 3*a*, a top plan view, illustrates another embodiment of a coupler-unit according to the principles of this invention. Right-angled coupler body frame 34 of coupler-unit 30 has coupling-means 12*a* affixed at and defining each apex, where coupling-means 12*a* provides for male or female coupling and decoupling of said coupler-unit to the cup-like coupling-means found on other coupling units and on the basic units. Unlike the cup-like coupling means described previously, the height of coupling-means 12*a* is limited to the height of coupler frame 34. Looking down into coupling-means 12*a* in the top plan view of FIG. 3*a*, gives the impression that the coupling-means are open holes because, as can be seen in the side view presented in FIG. 3*b* the circumference of coupling-means 12*a* increases with depth, whereas in FIG. 3*c*, which is a bottom plan view of the coupler coupling unit, both the bottom circumference line and the top circumference line are seen. As are the coupling means discussed above, the bottom ends of the coupling means 12*a* of coupler-unit 30 are open to receive other coupling means for coupling purposes. Incised into each of the two arms of coupler unit defining the right angle is a threaded aperture 36. The use for these apertures will become apparent in the discussion of FIG. 12.

Figure 4A:
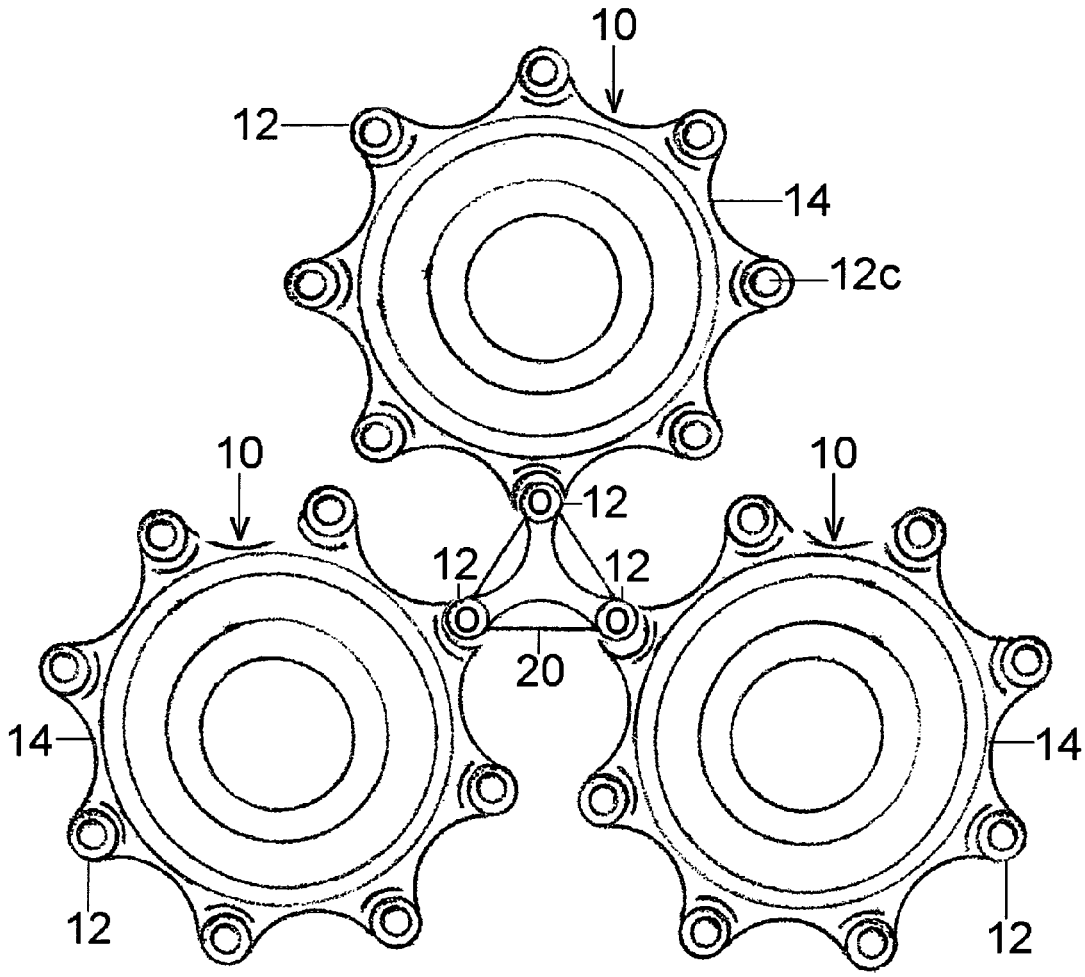
FIG. 4*a* is a top plan view of three basic units each coupled to a coupler-unit.
Figure 4B:
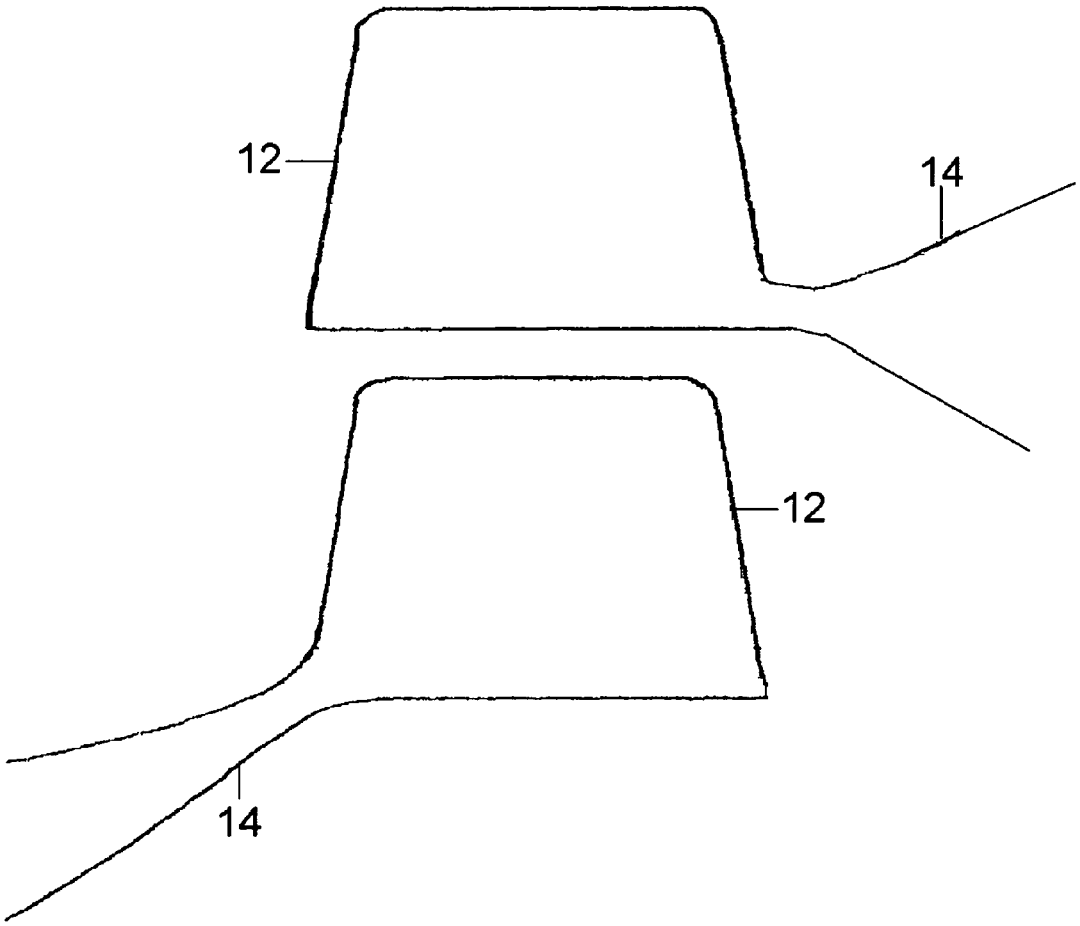
FIG. 4*b* is a perspective view of two cup-like coupling-means illustrating how the coupling-means couple.

FIG. 4*a*, a top plan view, illustrates three basic units 10 each coupled to coupler-unit 20 via coupling means 12 forming a multi-person sled. FIG. 4*b*, a side plan view, provides an enlarged view of two cup-like coupling-means 12 to illustrate how simple it is to couple and to decouple coupling-means. No tools or special skills are required for coupling. One cup-like coupling means is simply placed under or over another cup-like coupling means to couple. To decouple one cup-like coupling means is simply lifted up from or down away from the cup-like coupling means to which it is coupled. Although, FIG. 4*a* illustrates three basic units 10 coupled via coupler-unit 20 the three basic units 10 could just as easily and rapidly be coupled to each other without the use of coupler-unit 20.

Figure 5A:
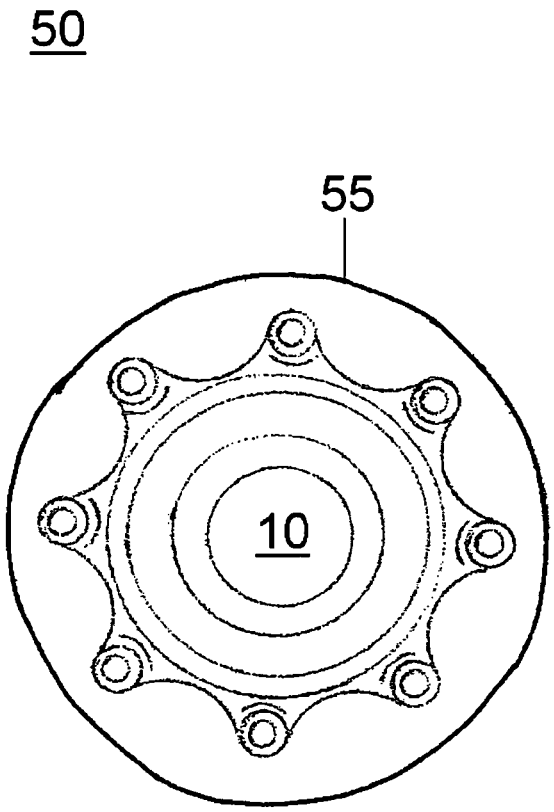
FIG. 5*a* is a top plan view of a basic unit positioned on an inner-tube for use in the water or on the snow or ice.
Figure 5B:
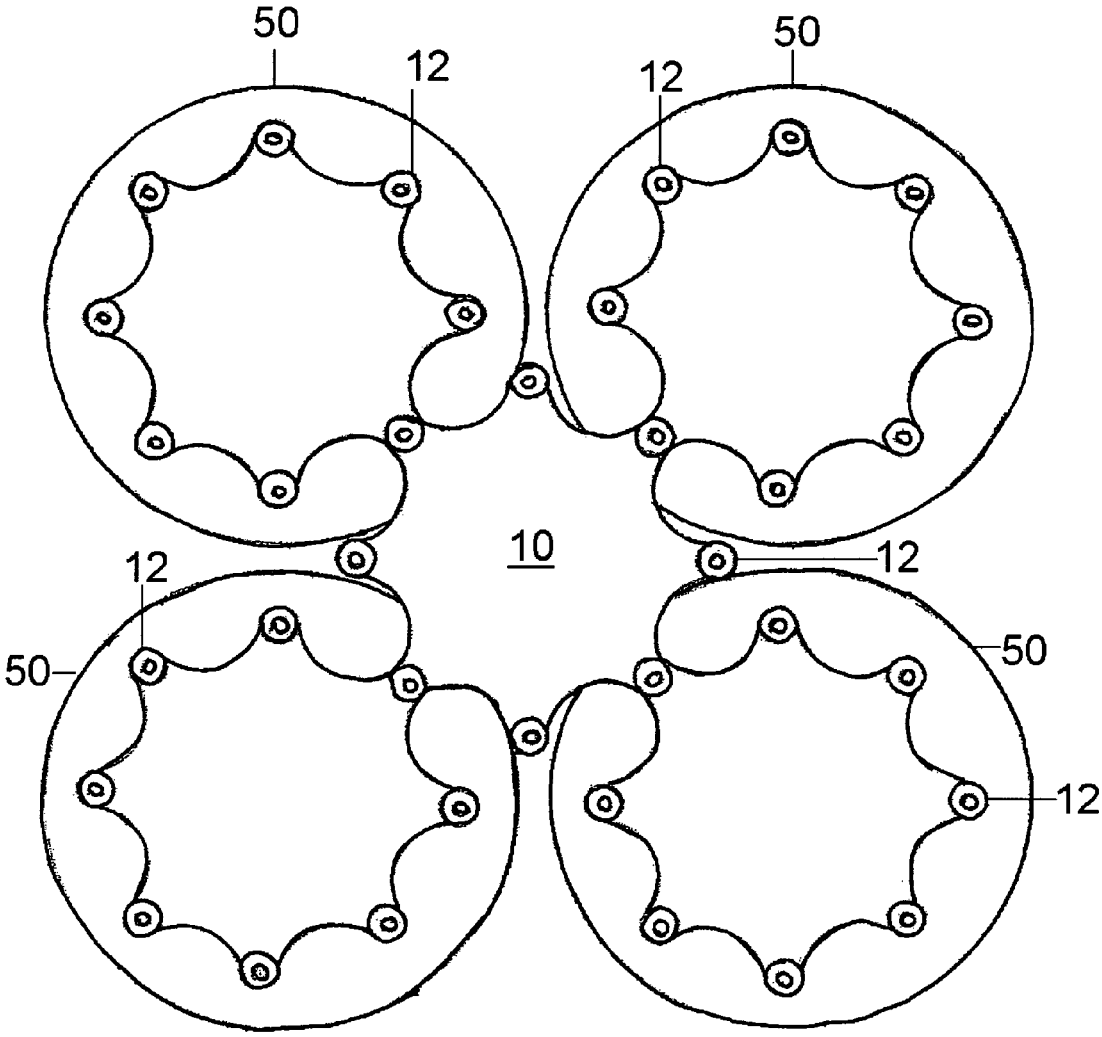
FIG. 5*b* is a top plan view of four basic units each situated on an inner-tube and each coupled to a basic unit not situated on an inner-tube.

FIG. 5*a*, a top plan view, illustrates basic unit 10 snugly situated on an inner-tube 55 providing tube-disc 50 for use in the water or on the snow or ice. FIG. 5*b*, a top plan view, illustrates four basic units 10 each situated on an inner-tube 55 and each coupled directly via coupling means 12 to basic unit 10 not situated on an inner-tube forming a multi-person device for use in the snow or water.

Figure 6A:
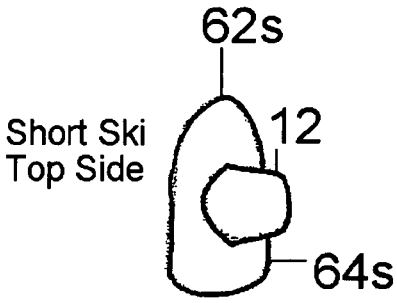
FIG. 6*a* is a partial perspective view illustrating a top side of a short ski having only one coupling-means.
Figure 6B:
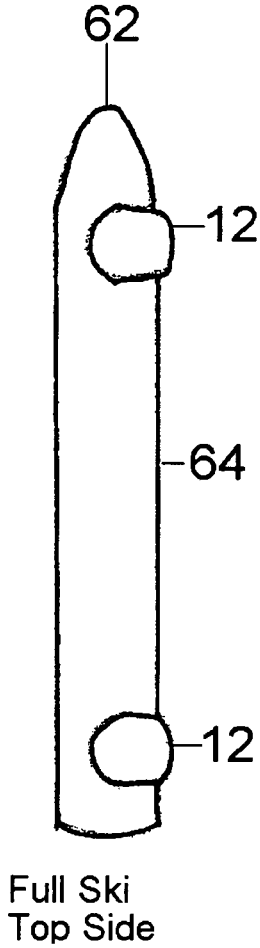
FIG. 6*b* is a partial perspective illustrating a top side of a full length ski having coupling-means on each of its two ends.
Figure 6C:
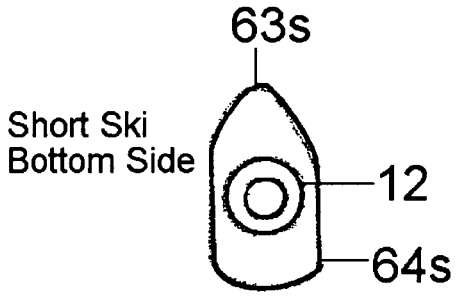
FIG. 6*c* is a plan view illustrating a bottom side of a short ski having only one coupling-means.
Figure 6D:
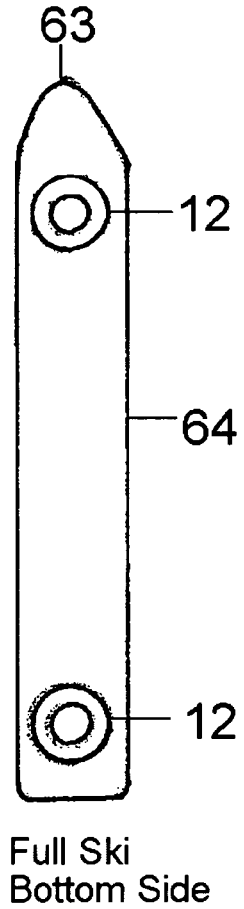
FIG. 6*d* is a plan view illustrating a bottom side of a full length ski having a coupling-means on each of its two ends.
Figure 6E:
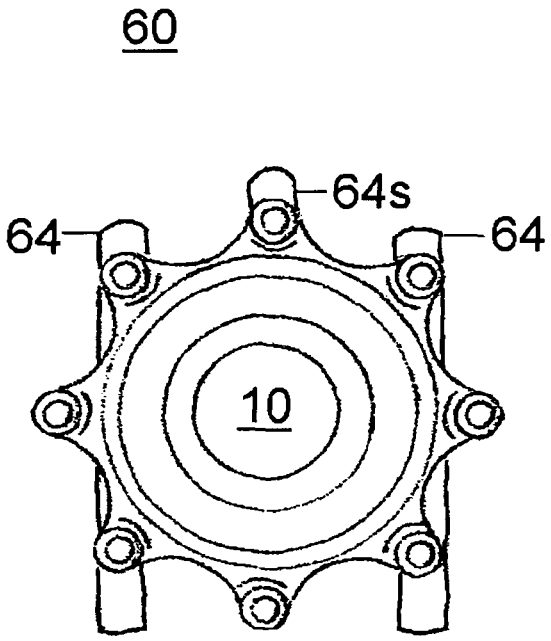
FIG. 6*e* is a top plan view illustrating a basic unit coupled to an accompanying set of couple-able skis including a set of two full length skis and one short ski.

FIG. 6*a*, a partial perspective view, illustrates a top side 62*s* of short ski 64*s* having only one coupling-means 12. FIG. 6*b*, a partial perspective, illustrates a top side 62 of full length ski 64 having coupling-means 12 on each of its two ends. FIG. 6*c*, a plan view, illustrates bottom side 63*s* of a short ski 64*s* having only one coupling-means 12. FIG. 6*d*, a plan view, illustrates bottom side 63 of full length ski 64 having a coupling-means on each of its two ends. FIG. 6*e*, a top plan view, illustrates basic unit 10 coupled to an accompanying set of couple-able skis and including a set of two full length skis 64 and one short ski 64*s* providing for ski-disc 60 that can be used to ski on snow or ice or for water skiing.

Figure 7:
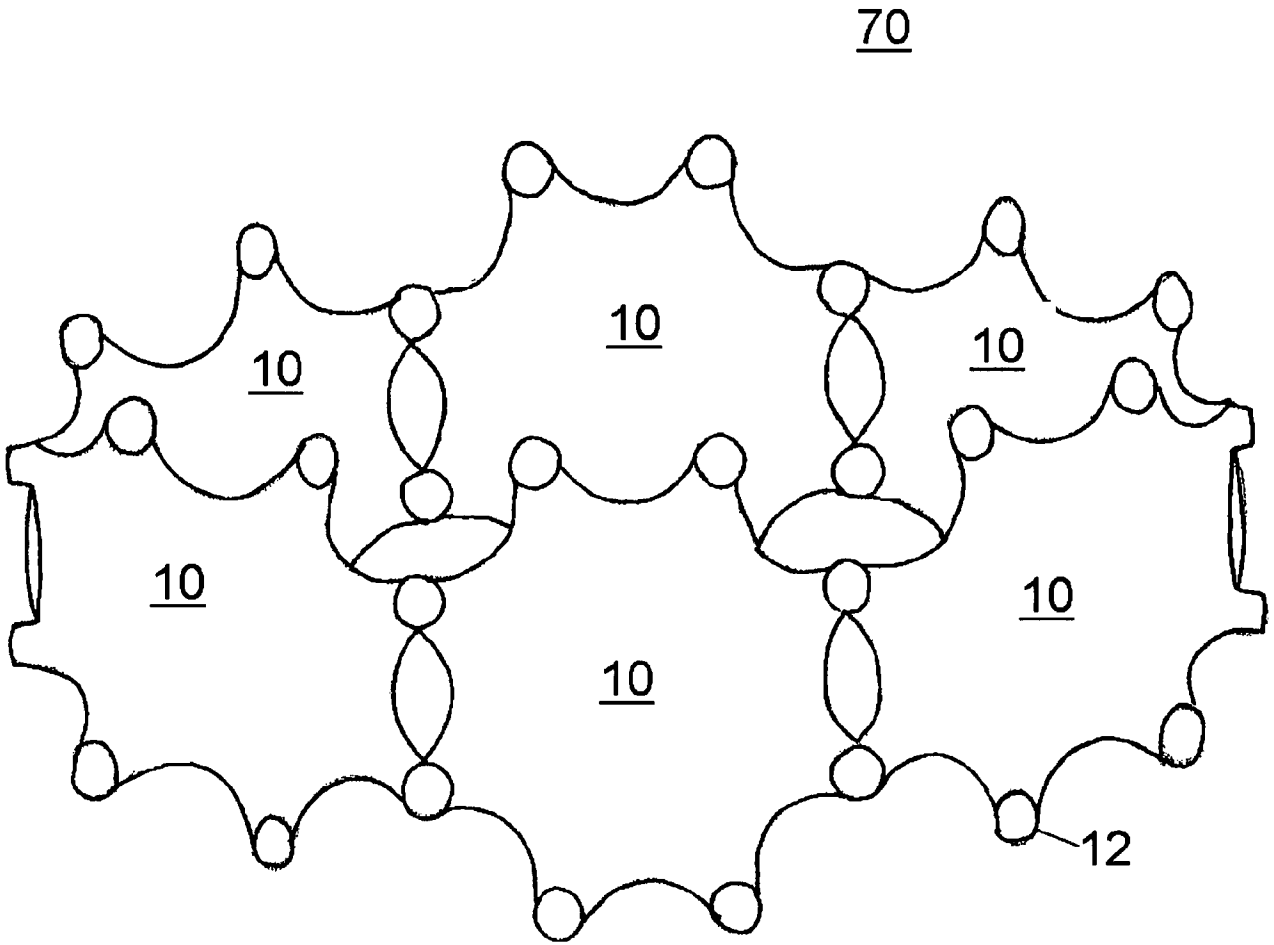
FIG. 7 is a perspective view illustrating six basic units coupled to each other forming a vertically-walled structure.
Figure 8:
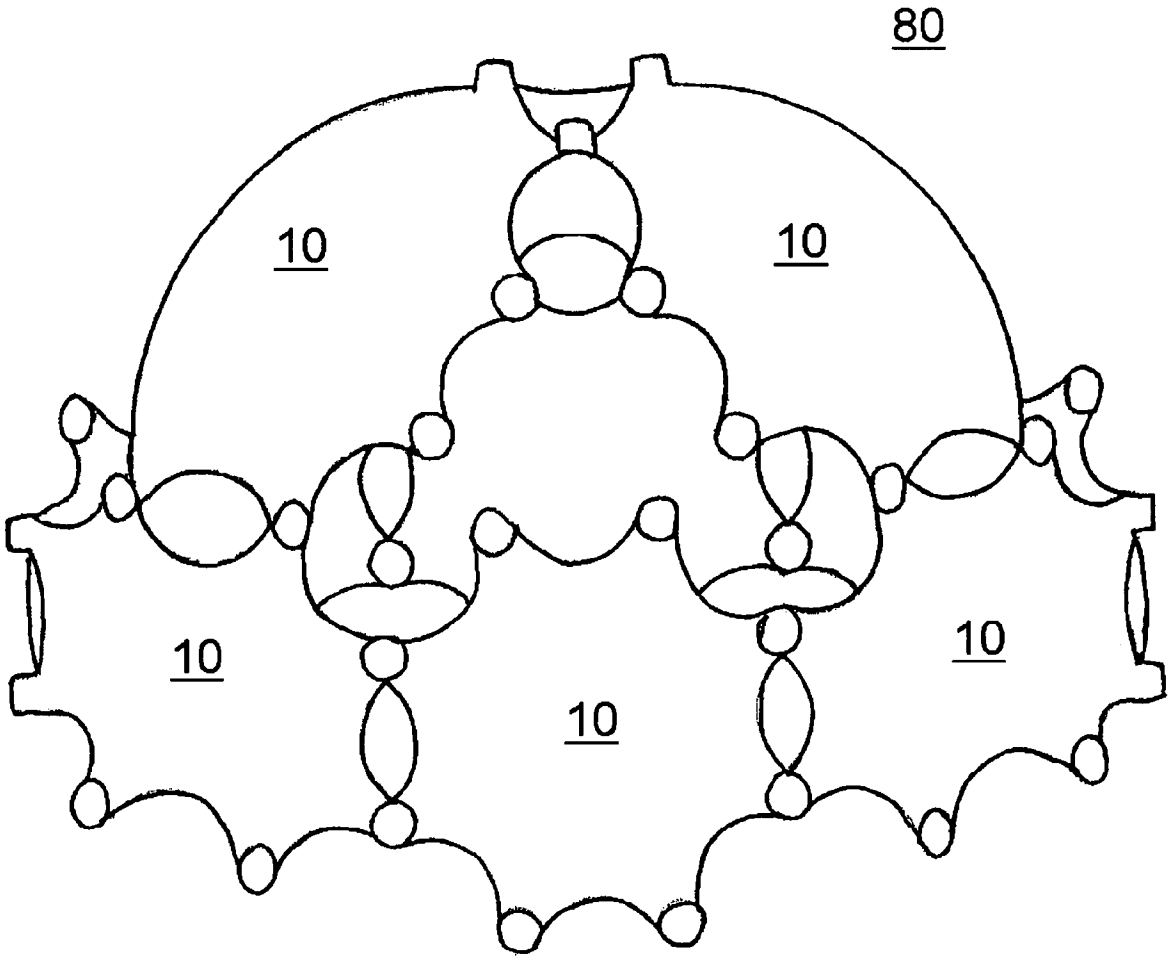
FIG. 8 is a perspective view showing a domed fort constructed from nine basic units coupled to each other.
Figure 9:
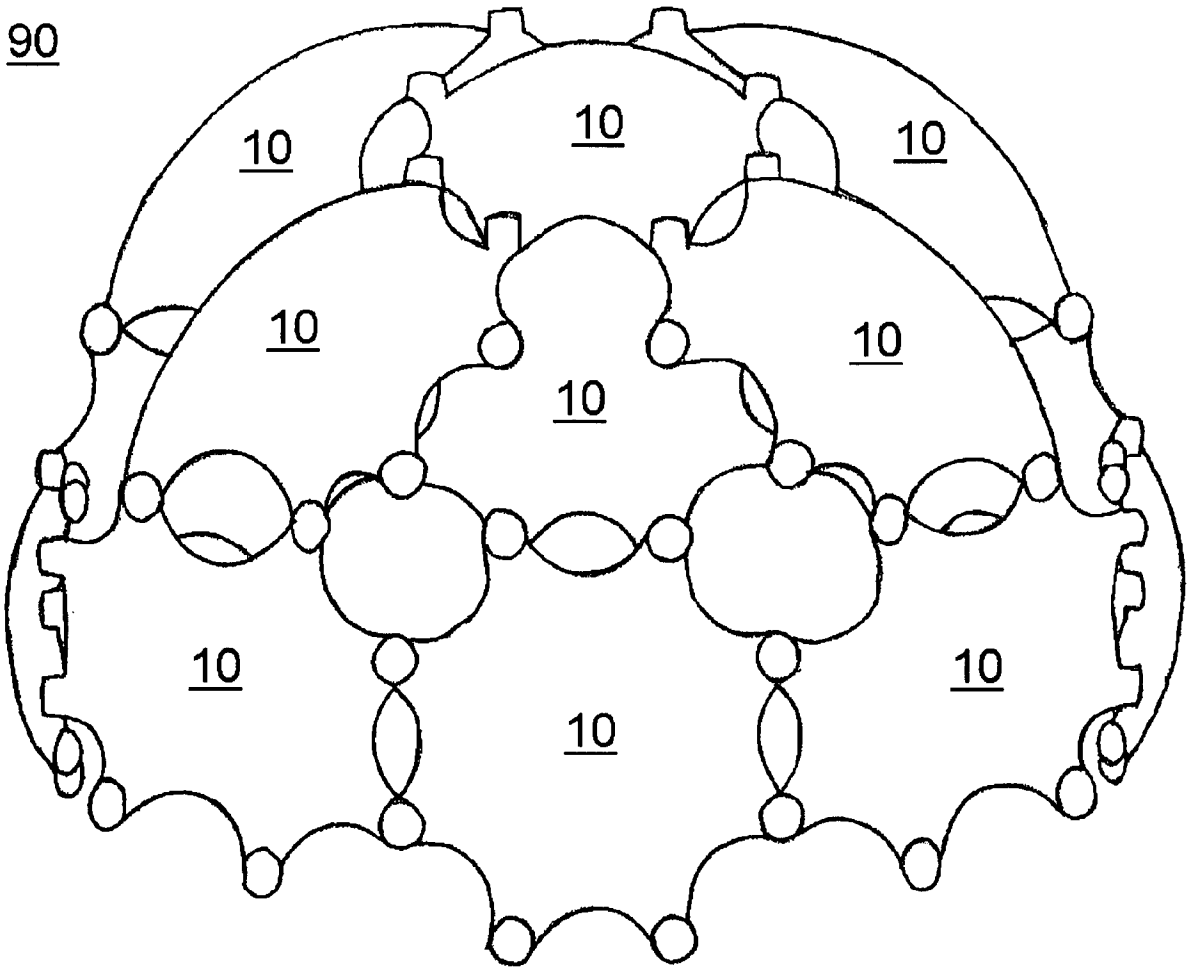
FIG. 9 is a perspective view showing domed fort constructed from thirteen basic units coupled to each other.

For indoor and all-season outdoor play, various numbers of basic units 10 may be coupled together to form structures, such as play forts of varying complexity. FIG. 7, a perspective view, illustrates six basic units coupled to each other forming vertically-walled structure 70. FIG. 8, a perspective view, illustrates nine basic units coupled to each other to form domed fort 80. FIG. 9, a perspective view, illustrates thirteen basic units coupled to each other to form more complicated domed fort 90. Each of the structures illustrated in FIGS. 7-9 are constructed by coupling the coupling means 12 of each basic unit directly to the coupling means of neighboring basic units. The ease by which the coupling and decoupling is accomplished and the light weight of the each of the modules means that even young children are able to build a fort of their imagination.

Figure 10A:
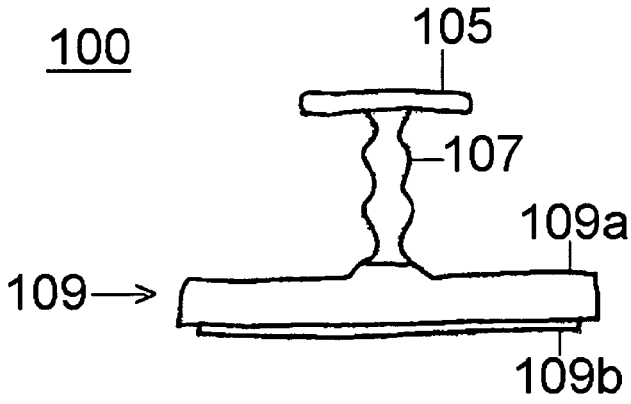
FIG. 10*a* is a side plan view illustrating a rotable sitting means.
Figure 10B:
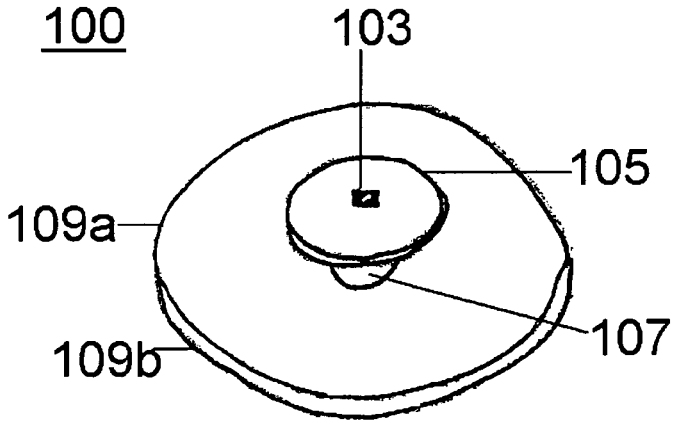
FIG. 10*b* is a perspective view of the rotable sitting means as illustrated in FIG. 10*a*.

FIG. 10*a*, a side plan view, and FIG. 10*b*, a perspective view, illustrate rotatable, turntable-like sitting device 100, another accessory part of the indoor and all season outdoor coupleable/decoupleable modular construction toy of the present invention. Rotatable sitting device 100 comprises rotable seating platform 105 rotably attached to shaft 107 that is in turn rotably connected to top cover part 109*a* rotably positioned over bottom support part 109*b* of base part 109. Rotatable sitting device 100 is a sit-on-able variation of a turntable. There are a number of known ways to construct turntables in the art and any of these would work within the principle of the present invention. The uses for rotatable sitting device 100 are limited only by the user's imagination. One contemplated use is described below.

Figure 11A:
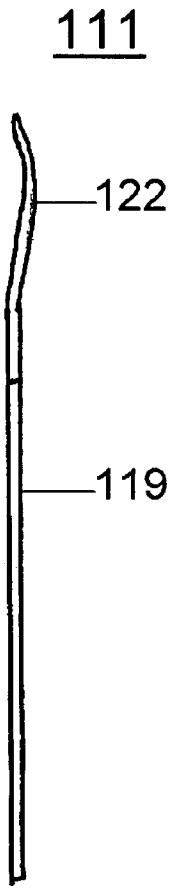
FIG. 11*a* is a side plan view of a multi-use device.
Figure 11:
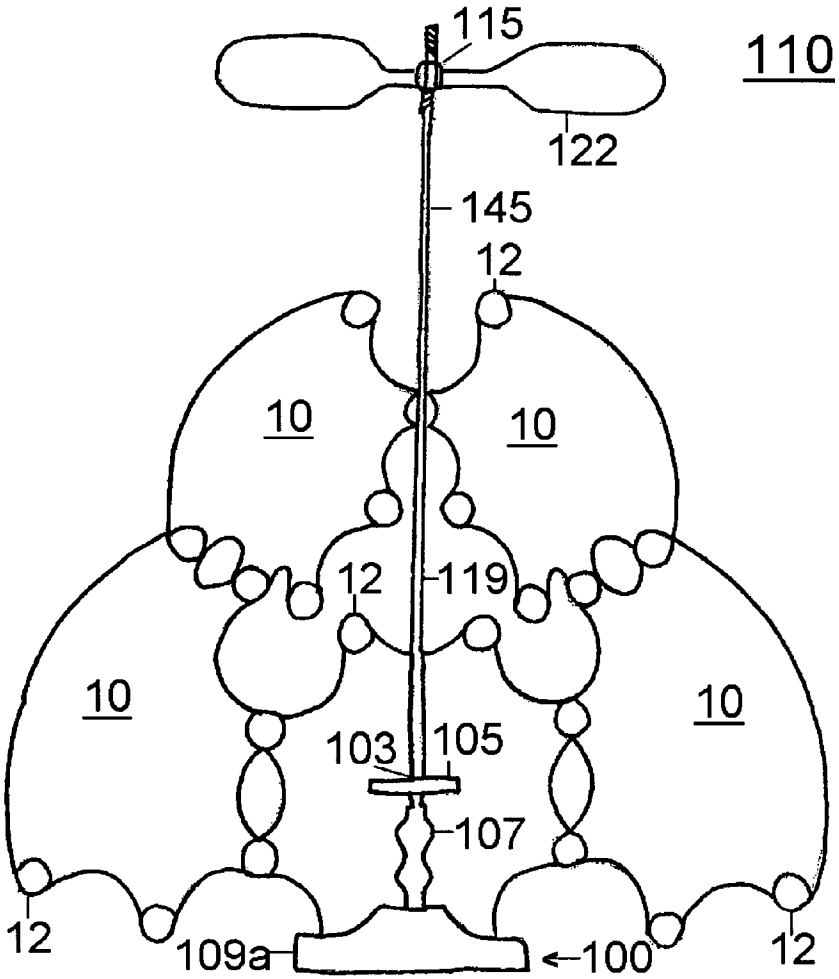
FIG. 11 is a side plan view of the fort as illustrated in FIG. 8 with the front central basic unit removed to show how a helicopter-like toy is constructed using the rotable sitting means as illustrated in FIG. 10*a*.

FIG. 11, which is, in part, a cutaway longitudinal view of the fort illustrated in FIG. 8 with the front central basic unit removed to provide a view of the inside of the fort, also illustrates rotable sitting device 100 positioned within the fort to construct helicopter-like toy 110. Rotable sitting device 100 comprises base 109*a*, connecting shaft 107, and rotable seat 105. FIG. 11*a*, a side plan view, illustrates multi-use device 111 comprising multi-use part 122 that functions as part of an oar, paddle, propeller, or support, for example, and multi-use shaft part 119. In the embodiment illustrated, there are also accessory parts long rod-like shaft 119 and rear tire axel 145 that, in this instance, are connected to each other, for example, by screwing their reciprocally receiving threaded ends together or alternatively, if desired to be manufactured without threaded parts, by friction fitting the parts to each other. There are many ways to connect such shafts known to those of ordinary skill in the art and, thus, need not be discussed in any further detail here. One end of the two section rod-like shaft is then connected to rotatable sitting device 100 using, for example, receiving threaded aperture 103. The opposite end of the elongated, the two section rotable shaft is connected to rotable connecting part 115 to which propeller-like blades 122 are also connected. To make the propeller-like blades 122 spin, a child, for example, may simply sit on rotable seating part 105 of rotatable sitting device 100 and use his or her feet to rotate the seat, which turns the two section shaft, which turns part 115, which turns the propellers.

Figure 3B:
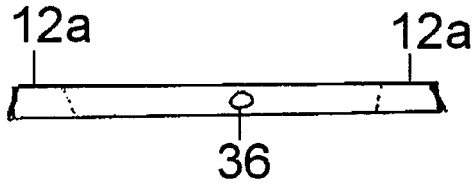
FIG. 3*b* is a partial perspective view of the coupler-unit illustrated in FIG. 3*a*.
Figure 3C:
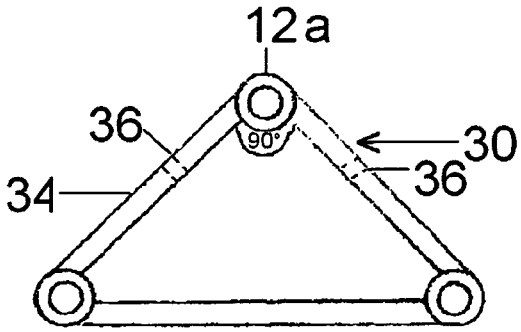
FIG. 3*c* is a side plan view of the coupler-unit, as illustrated in FIGS. 3*a* and 3*b*.
Figure 12:
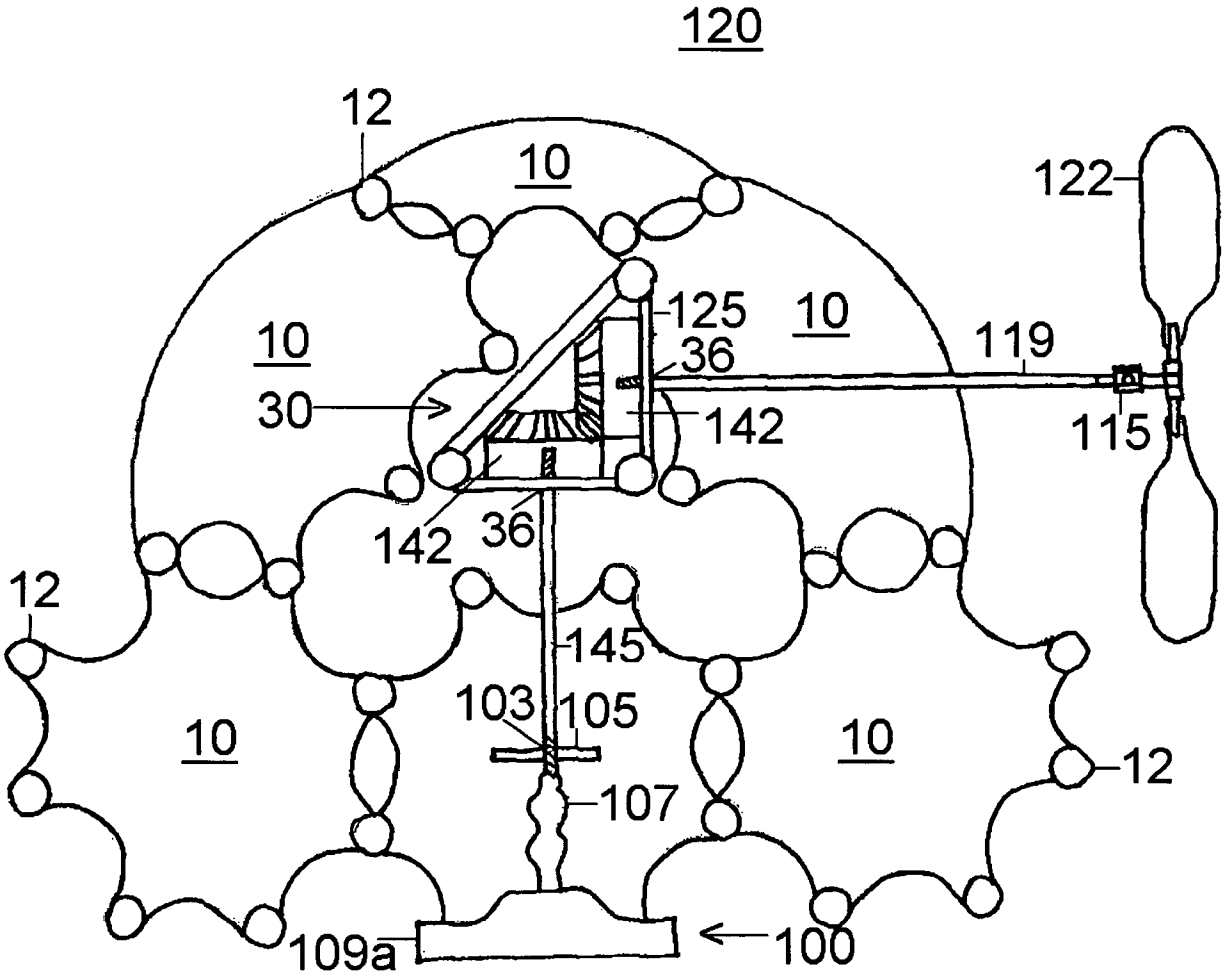
FIG. 12 is a side plan view of the fort as illustrated in FIG. 9 with front basic unit removed to show how an airplane-like toy is constructed using the rotable sitting means as illustrated in FIG. 10*a* with gear means.

FIG. 12, a side plan view illustrates airplane-like toy 120 constructed using the fort shown in FIG. 9. Several of the front basic units of the fort are removed to provide a view of the airplane propeller driving structure constructed within the interior of the fort. To make the airplane propeller driving structure, the inside surface of a first rear tire 142 is positioned against the inside surface of the first right angle defining arm of coupler-unit 30, as is illustrated in FIGS. 3*a*, 3*b*, and 3*c*, so that the threaded receiving aperture 142*c* of first rear tire 142 is aligned with threaded receiving aperture 36 of the first right angle defining arm of coupler-unit 30, then the inside surface of a second rear tire 142 is positioned against the inside surface of the second right angle defining arm of coupler-unit 30 so that the threaded receiving aperture 142*c* of second rear tire 142 is aligned with threaded receiving aperture 36 of the second right angle defining arm of coupler-unit 30. Next, a first end of rear tire axel 145 is rotably connected to rotable sitting means 100 while the second end of rear tire axel 145 is screwed into threaded receiving aperture 36 of first right angle defining arm of coupler-unit 30 and then into threaded receiving aperture 142*c* of rear tire 142. Similarly, screwed into threaded receiving aperture 36 on the second right angle defining arm of coupler-unit 30, is a first end of rod-like shaft 119. Connected to the second end of shaft 119 is rotable connecting part 115 for connecting propeller-like blades 122.

Figure 13:
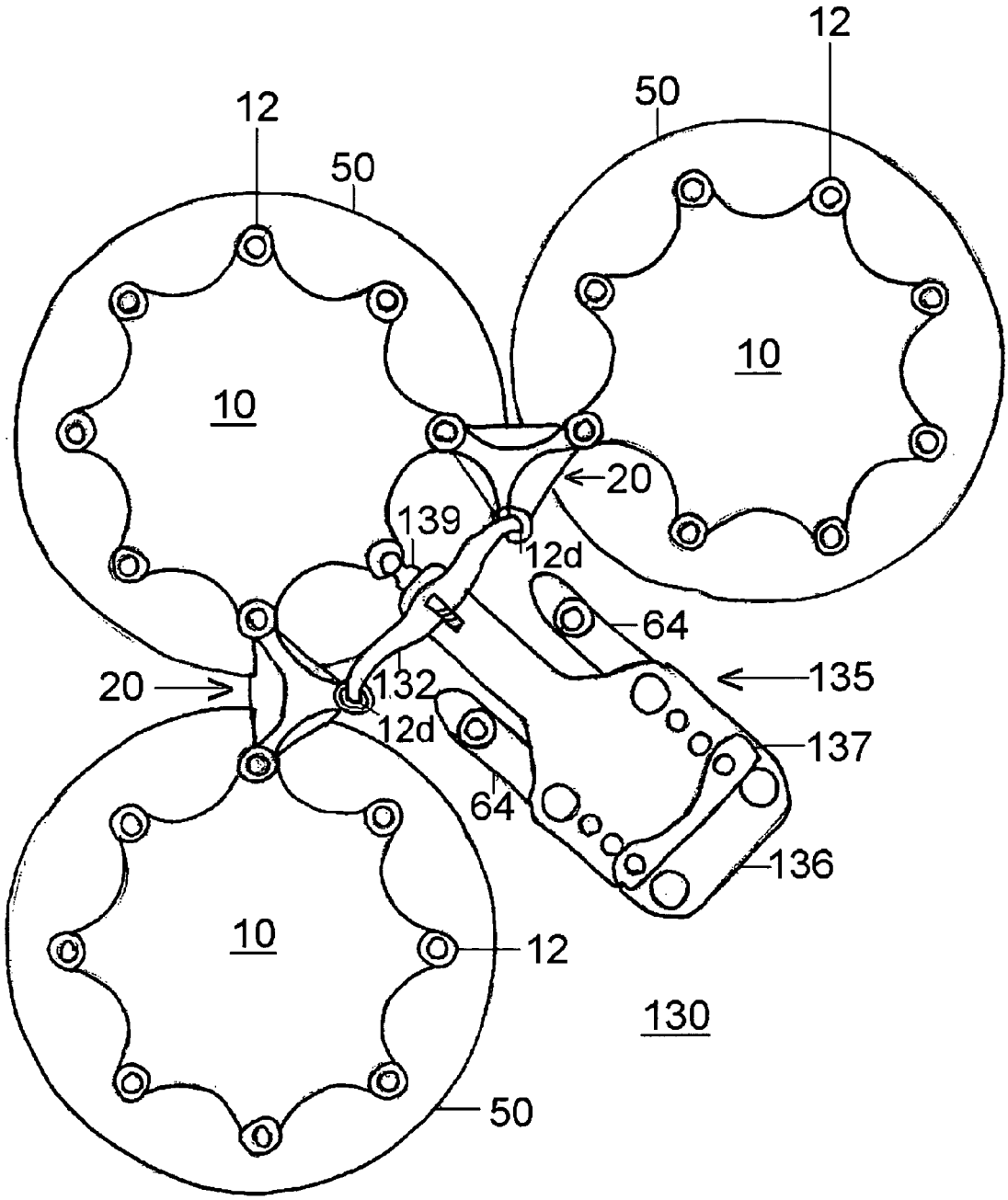
FIG. 13 is a top plan view of a steerable multiple coupled tube-discs sled.
Figure 13A:
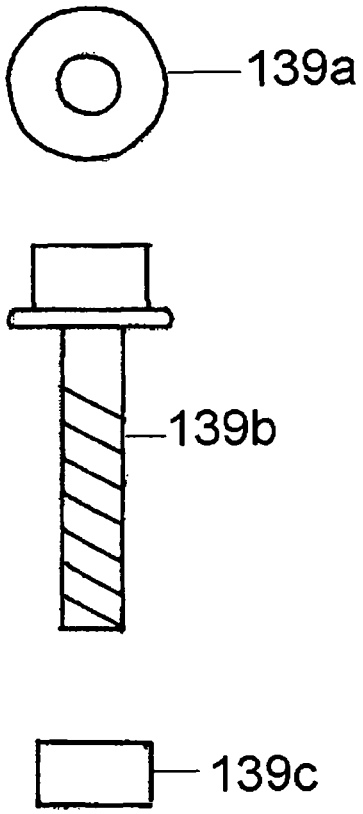

FIG. 13, a top plan view, illustrates a first, second, and third tube-disc 50 coupled to each other and to coupleable sled 135 to form steerable multiple coupled tube-discs sled 130. In particular, steerable multiple coupled tube-discs sled 130 comprises a first tube-disc 50 coupled via two coupler-means 12 of first coupler-unit 20 to second tube-disc 50 which is coupled via two coupler-means 12 of second coupler-unit 20 to third tube-disc 50. Coupleable, steerable sled 135 is coupled to second tube-disc 50 via coupleable sled attachment means 139. Coupleable sled attachment means 139 comprises washer 139*a*, threaded bolt 139*b*, and nut 139*c* (illustrated in FIG. 13*a*). Coupleable steerable sled 135 comprises coupleable accessory seat 136 coupled to first and second full length skies 64 with coupling-means, as described above. The steering of tube-discs sled 130 is accomplished using coupleable steering bar 133 that is coupled to the sled, in this embodiment by screwing steering bar mechanism 133 onto threaded coupleable sled attachment means 139. A first end of steering bar 133 is adapted to fit into aperture 12*d* of the coupling-means 12 of first coupler-unit 20 that is not being used to couple the first and second tube-discs 50 while a second end of steering bar mechanism 133 is adapted to fit into aperture 12*e* of the coupling-means 12 of second coupler-unit 20 that is not being used to couple the second and third tube-discs 50 so that moving an end of the steering bar in a desired direction directs the movement the tube-disc functionally attached to that end of the steering bar to move in the desired direction. Optional coupleable backrest 137 may be coupled to coupleable accessory seat 136 providing for a more comfortable ride.

Figure 14A:
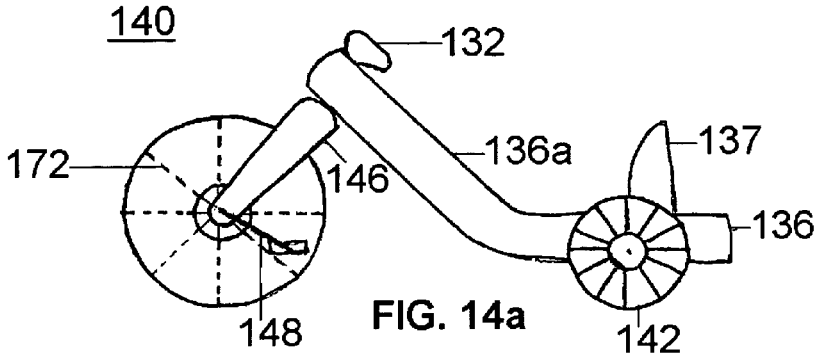
FIG. 14*a* is a side plan view of a coupleable tricycle.
Figure 14B:
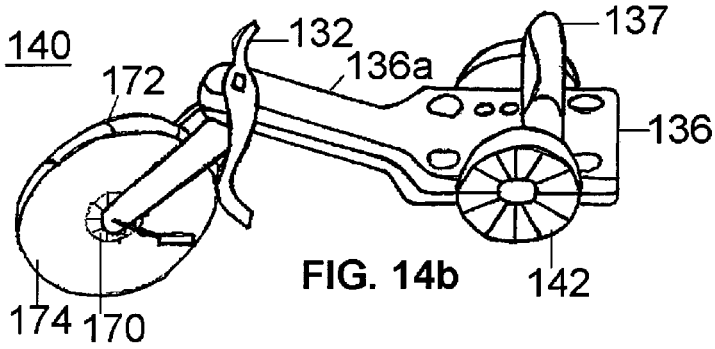
FIG. 14*b* is a perspective view of coupleable tricycle, as illustrated in FIG. 14*a*.
Figure 14C:
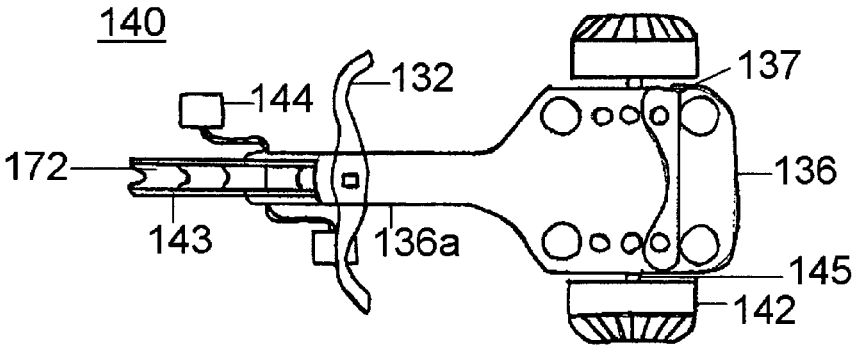
FIG. 14*c* is a top plan view of coupleable tricycle as illustrated in FIG. 14*a* and FIG. 14*b*.
Figure 14D:
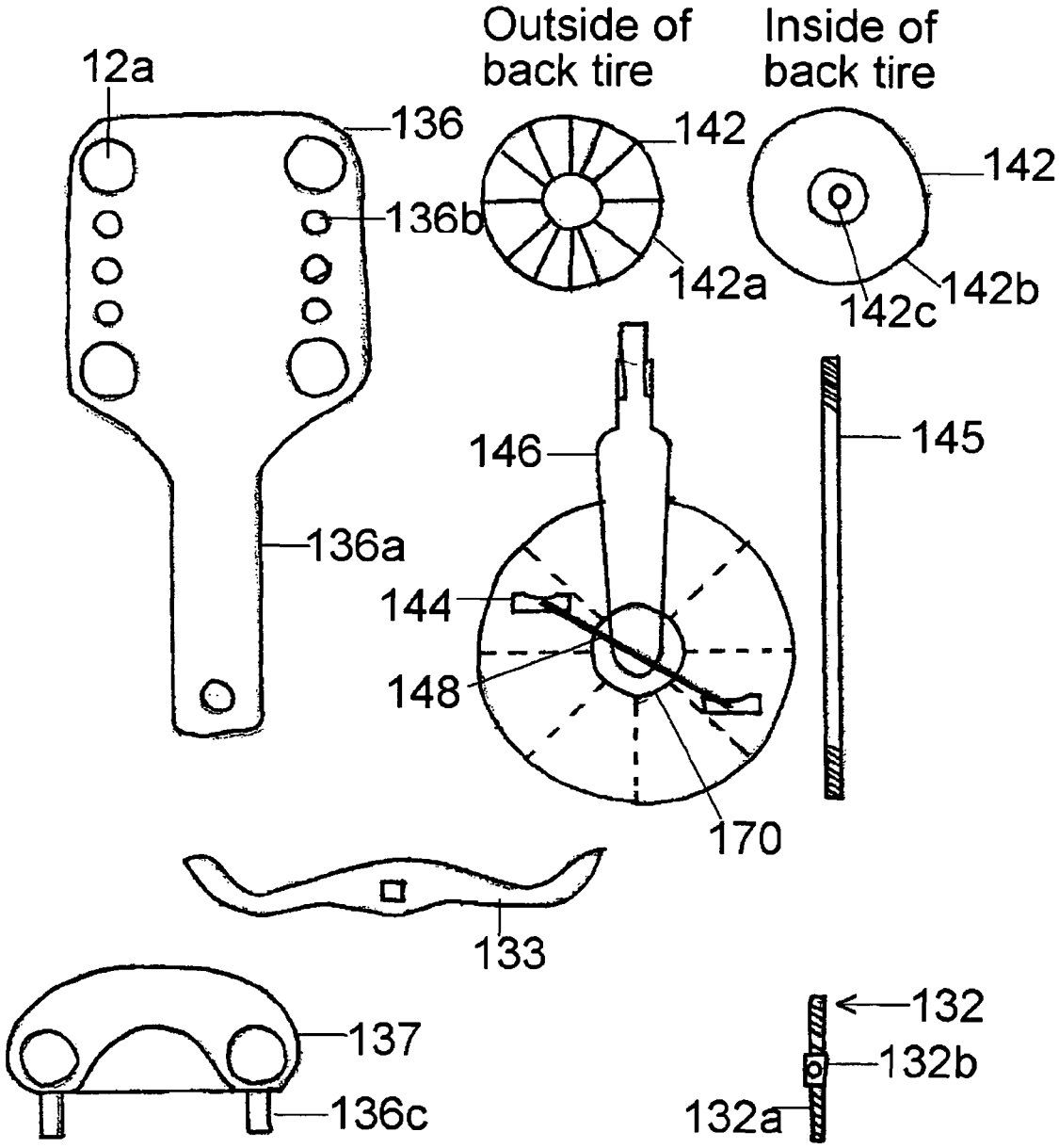
FIG. 14*d* is a plan view of the individual parts used to make the coupleable tricycle, as illustrated in FIG. 14*a*, FIG. 14*b*, and FIG. 14*c*.

FIG. 14*a*, a side plan view, FIG. 14*b*, a perspective view, and FIG. 14*c*, a top plan view, illustrate yet still another way the accessory parts of the coupleable construction toy of the present invention may be used for creative construction. In this embodiment, the accessory parts provide for the construction of coupleable tricycle 140. FIG. 14*d* provides a plan view of the individual accessory parts that are used to make coupleable tricycle 140. In particular, coupleable tricycle 140 comprises coupleable accessory seat 136 adapted for rotably receiving rear axel 145 onto which is mounted the pair of rear wheels 142. FIG. 14*d* illustrates the individual parts used in the construction of the coupleable tricycle, such as threaded axel receiving aperture 142*c* located on the inside side 142*b* of rear wheel 142 opposite outside side 142*a*. Optional backrest 137 may be coupled onto the sitting surface of accessory seat 136 by inserting coupleable stems 136*c* into coupleable accepting apertures 136*b*. The upwardly directed portion 136*a* of accessory seat 136 supports steering fork 146 of conventional construction to be functionally engaged with steering bar mechanism 133. Front wheel 143 is of conventional construction in that it includes an axle (not shown) that extends outwardly from both planar wheel cover faces 174 of the extent of the wheel through steering fork 146 to be then bent into a pair of oppositely disposed crank arms 148 that in turn support pedals 144. Front wheel 143 is constructed to function as a tricycle front wheel and as a water cycle wheel (which will be discussed below), therefore the wheel construction includes a right side planar face 174 wheel cover and a left side planar face wheel cover each having opening or aperture 170 in the center. Aperture 170 serves to receive the axle and also serves as an inlet for water when used as part of the water cycle. Instead of ordinary spokes, front wheel 143 has "water wheel blades" 172 that are constructed and function just as the blades or paddles do on a conventional water wheel, however, the only function "water wheel blades" 172 serve coupleable tricycle 140 is to provide support to the wheel and to the tricycle.

Figures 15, 15A:
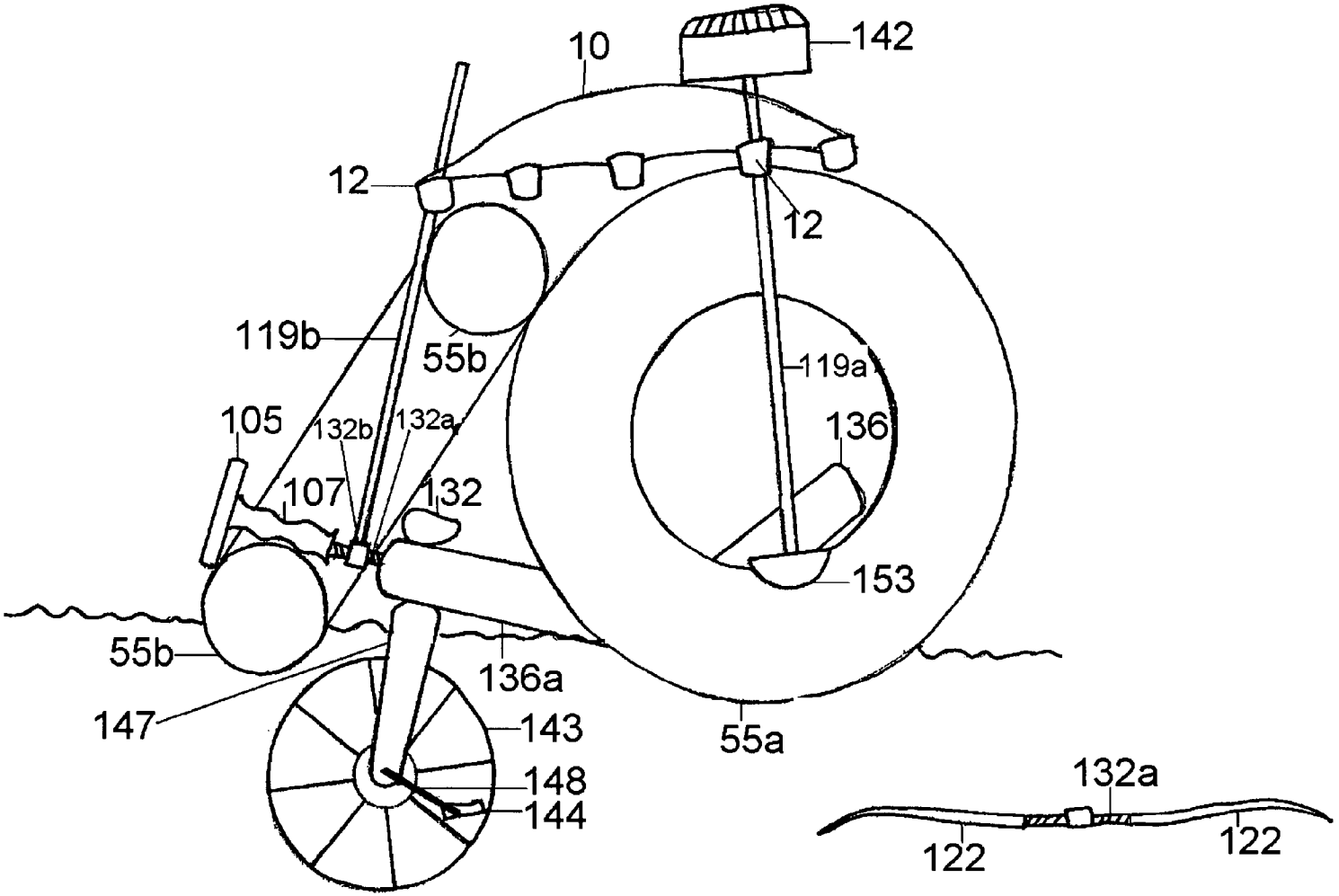
FIG. 15 is a side plan view of a water disc-cycle.
FIG. 15*a* is a side plan view illustrating the construction used to support seat, to secure first and third inner-tube to the seat, and to support sun-roof basic unit.

Yet still another imaginative construction that can be constructed using the accessory parts already described with the addition of one other part is water disc-cycle 150, as illustrated in FIG. 15. The buoyancy of water disc-cycle 150 is, in part, maintained by a first 55*a*, second 55*b*, and third inner-tube (third inner-tube is hidden from view behind first inner tube 55*a*). Water disc-cycle 150 comprises accessory seat 136. Upwardly directed portion 136*a* of accessory seat 136 supports steering fork 146 for functional engagement with steering bar mechanism 133. Front wheel 143 is of conventional construction in that it includes an axle (not shown) that extends outwardly from both planar wheel cover faces 174 of the extent of the wheel through steering fork 146 to be then bent into a pair of oppositely disposed crank arms 148 that in turn support pedals 144. Front wheel 143 is constructed to function as a water cycle wheel in addition to a tricycle wheel therefore the construction includes a right side planar face cover 174 and a left side planar face wheel cover 174 (mirror image cannot see in illustration) having an aperture in the center. The aperture serves to hold the axle and as an inlet for water when used as part of the water cycle. Instead of spokes, front wheel 143 has "water wheel blades" 172 (see FIGS. 14*b* and 14*c*) that are constructed and function just as the blades or paddles do on a water wheel. Peddling pedals 144 in a conventional peddling manner turns water wheel 143 which causes water disc-cycle 150 to be propelled through the water. Opening 170 allows water to be drawn in adding to the amount of water present to turn the wheel. Attached to upwardly directed portion 136*a* of accessory seat 136 via rod shaped connector means 132*a* is rotable shaft 107 that is in turn connected to seating part 105 that is hooked over the second inner-tube to hold the second inner-tube securely to the cycle. Basic disc 10 provides for a sun roof for the user who sits on accessory seat 136. Basic disc 10 is supported in its sun roof position by three long, rod-like shafts, of which only 119*a* and 119*b* can be seen in the figure. FIG. 15*a* illustrates the construction used to support seat 136, to secure first and third inner-tube to seat 136, and to support sun-roof basic unit 10. Each end of rear tire axel, which is used as the support for seat 136 is connected to a paddle part 122 via connector attachment means 132. In particular, the male threaded ends of 145 and 122 and secured into the female threaded accepting part of 132*b* forming not only a support for seat 136, but providing the curved blades 122 that rests on first inner tube 55 and on not seen third inner tube. Moreover, the threaded ends of parts 132*a* are now in position to be connected to the complementary threaded ends of shaft 119*a* (as a mirror image, and thus not shown, first end of the third shaft is supported by a second propeller-like curved blade that rests on third inner tube) which positions shaft 119*a* to be inserted through the coupling-means 12 to be screwed into the axel accepting aperture 142*c* (as illustrated in FIG. 14*d*) of rear wheel 142 which is situated on top of basic unit 10 to hold basic unit 10 securely in its place as a sun umbrella. Again, in mirror imagine and thus not shown, there is an identical support on the other side of the device. First shaft 119*a* also serves to keep first inner tube 55*a* fixed to water disc-cycle 150. A second support for basic disc 10 sun roof is provided by second shaft 119*b* where first end of second shaft 119*b* is supported in coupling connector aperture 132*b* that is fixed about rod shaped connector means 132*a* while second end of second shaft 119*b* is positioned through the apertures of a second coupling cup 12 to provide support for basic disc 10. Securely tucked in between and supported by second shaft 119*b* and first inner tube 55*a* is second inner tube 55*b*, which is also kept securely related to the cycle by rotable shaft 107 that is connected to seating part 105. Only the rearward half of second inner tube 55*b* is shown so as not to obscure the relationship between second inner tube 55*b* and the cycle parts. Hidden from view in this figure, is third inner tube that is a mirror image of first inner tube 55*a* which also provides support for the opposite side of basic disc 10.

Figure 16A:
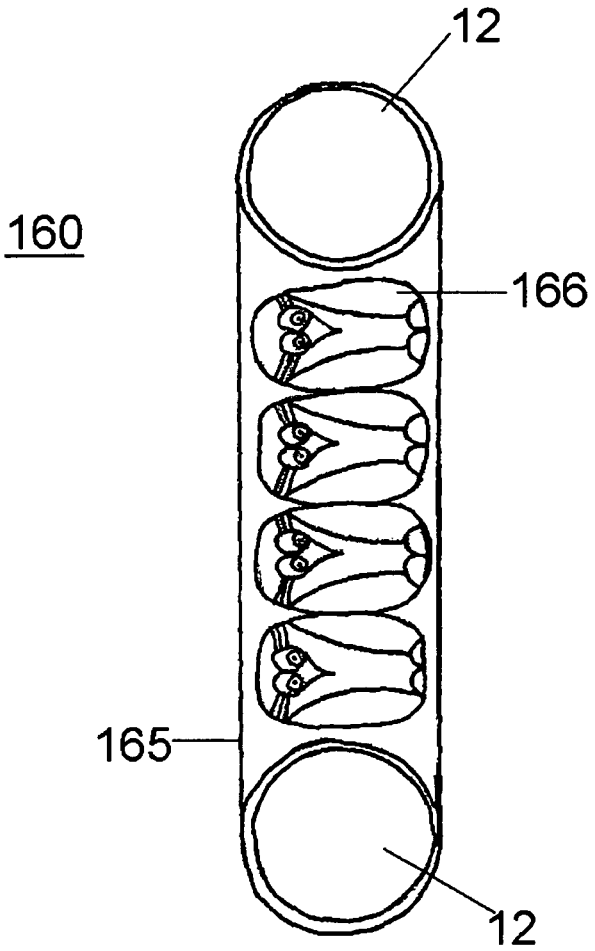
FIG. 16*a* is a top plan view illustrating yet another style coupler-unit of this invention.
Figure 16B:
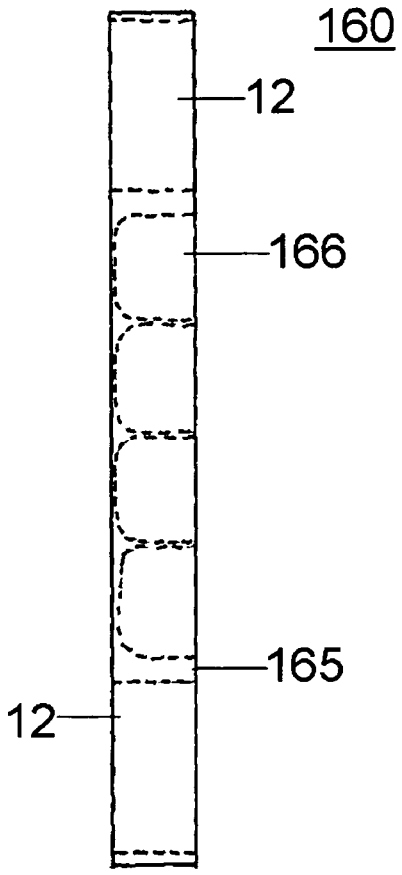
FIG. 16*b* is a side plan view illustrating yet another style coupler-unit of this invention, as illustrated in FIG. 16*a*.

FIG. 16*a* is a top plan view and FIG. 16*b* is a side plan view illustrating yet another style coupler-unit of this invention. Coupler-unit 160 serves as a bi-coupler having first coupler 12 on a first end of body part 165 and second coupler 12 on a second end of body part 165. Coupler-unit 160 also serves as a means for making snow or ice cube-like toys. Body part 165 of coupler-unit 160 is provided with a plurality of casting impressions 166 that can be filled with snow or water. In the example illustrated in FIG. 16*a* the impressions are of a penguin, but they can be of anything desired. Once the snow or water sets or freezes in the cast to form a set of molded impression toys, the molded toys are removed from the casts. The toys can be used in a multitude of ways. One way is for children to throw the toys down a snowy hill to see who can retrieve the largest number of toys as they slide down the hill on their coupleable sled, for example. The toys may be used to play catch, for juggling, or to throw through coupler openings, to give just a few more examples. The toys of this invention are designed to allow and encourage children to use their imaginations.

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. A modular construction toy, comprising:

a basic unit having:

a body section delineated by a perimeter defining a circle or an equilateral regular polygon, having:

a central, depressed, child or adult user-supporting seating area, and couplers extending out from the perimeter, said couplers each structured with one end as a male coupler and another end as a female coupler, each of said couplers extending upwards perpendicularly from said body section, each of said couplers integrally molded with said body section forming a seamless, continuous extension of said body section, each of said couplers being open-ended on each end when not in use and when coupled in use, said couplers couple-able to like said couplers of other units.

2. The modular construction toy, as recited in claim 1, further comprising one or more discrete coupler-units, each of said one or more discrete coupler-units having one or more couplers extending out from a coupler attachment section, said couplers molded with said coupler attachment section forming a seamless coupler-unit.

3. The modular construction toy, as recited in claim 2, wherein said couplers of said coupler-units further comprise each of said couplers having a male coupler end and a female coupler end, each of said couplers being open-ended on each end when not in use and when coupled in use, and said couplers couple-able to like said couplers.

4. The modular construction toy, as recited in claim 2, wherein said discrete coupler-units further comprise:

a) a central body section having a perimeter, and b) a plurality of male/female couplers extending out from said perimeter, said couplers couple-able to like couplers and coupler-units.

5. The modular construction toy, as recited in claim 1, wherein said body section of said basic unit further comprises a disc having a circular perimeter.

6. The modular construction toy, as recited in claim 1, wherein said body section of said basic unit further comprises a disc having a hexagonal perimeter.

7. The modular construction toy, as recited in claim 1, wherein at least one of said couplers further comprises a truncated-cone-shaped coupler.

8. The modular construction toy, as recited in claim 2, wherein at least one of said coupler-unit couplers further comprises a truncated-cone-shaped coupler.

9. The modular construction toy, as recited in claim 8, wherein said at least one truncated-cone-shaped-coupler further comprises an aperture at each cup end.

10. The modular construction toy, as recited in claim 2, wherein at least one of said couplers of one said basic unit and at least one of said couplers of another of said basic unit are coupled to each other via said couplers of one of said coupler-units providing for a plurality of at least two basic units coupled by at least one said coupler-unit.

11. The modular construction toy, as recited in claim 1, wherein at least one of said couplers of at least one said basic unit and at least one of said couplers of at least one other said basic unit are coupled to each another providing for at least a bi-coupled basic unit modular construction toy.

12. The modular construction toy, as recited in claim 2, wherein said discrete coupler-units include at least one couple-able ski equipped with one or more male/female couplers, said couplers couple-able said basic unit.

13. The modular construction toy, as recited in claim 12, wherein said at least one of said couple-able skis comprises only one male/female coupler.

14. The modular construction toy, as recited in claim 12, wherein said at least one of said couple-able skis comprises at least two male/female couplers.

15. A modular construction toy, comprising:

a basic unit, and discrete male/female coupler-units, said basic unit having:

a body section having a depressed user-supporting, seating area center capable of supporting a child or an adult and a perimeter defining a circle or a regular polygon, and male/female open-ended couplers each structured to perform as a female and a male coupler, each extending out and upwards perpendicularly from the perimeter area of the body section, and each molded in the same mold as said body section as a continuous integral extension of said body section, said couplers couple-able to:

(a) like said couplers of other said basic units, and (b) one or more of like said couplers of said discrete male/female coupler-units that each have at least two male/female open-ended couplers, all said couplers remaining open-ended on each end when coupled.

16. The modular construction toy, as recited in claim 15, further comprising said body section having a circular disc-shape.

17. A modular construction toy, comprising:

a basic unit, and discrete male/female coupler-units, said basic unit having: a body section defined as a regular polygon or a circle, a depressed center constructed to support a user, a perimeter, and male/female couplers all molded as an integral part of said body section extending out and upwards from the perimeter, said basic unit couple-able with another basic unit or with one or more of said discrete male/female coupler-units, each of said units having two or more of said male/female couplers, providing for the coupling of two or more basic units using coupler-units or by direct basic unit to basic unit coupling, all said couplers remaining open-ended on each end when coupled.

* * * * *